US008011918B2

(12) United States Patent
Erickson et al.

(10) Patent No.: US 8,011,918 B2
(45) Date of Patent: Sep. 6, 2011

(54) DEVICE FOR APPLYING FILLER MATERIAL

(76) Inventors: Stephen D. Erickson, San Francisco, CA (US); Sang Jin Lee, Oakland, CA (US)

( * ) Notice: Subject to any disclaimer, the term of this patent is extended or adjusted under 35 U.S.C. 154(b) by 522 days.

(21) Appl. No.: 12/049,264

(22) Filed: Mar. 14, 2008

(65) Prior Publication Data

US 2008/0222997 A1 Sep. 18, 2008

Related U.S. Application Data

(60) Provisional application No. 60/894,811, filed on Mar. 14, 2007.

(51) Int. Cl.
*B05C 17/10* (2006.01)

(52) U.S. Cl. ..... 425/458; 425/470; 425/472

(58) Field of Classification Search ..... 425/458, 425/472, 470; 15/235.7, 235.5; 2/21; 223/101
See application file for complete search history.

(56) References Cited

U.S. PATENT DOCUMENTS

| | | | | |
|---|---|---|---|---|
| 2,351,906 | A * | 6/1944 | Beatty | 2/21 |
| 3,964,854 | A | 6/1976 | Groeneveld | |
| 4,177,698 | A | 12/1979 | Greneker | |
| 5,018,956 | A | 5/1991 | Lemaster | |
| 5,609,165 | A * | 3/1997 | Lambert | 128/880 |
| 5,675,860 | A | 10/1997 | Campbell | |
| 6,305,926 | B1 | 10/2001 | Ray | |
| 2003/0056274 | A1 * | 3/2003 | Sorrels | 2/21 |
| 2004/0025227 | A1 * | 2/2004 | Jaeger | 2/161.6 |
| 2006/0037165 | A1 * | 2/2006 | McDevitt et al. | 15/227 |

* cited by examiner

*Primary Examiner* — Maria Veronica D Ewald
(74) *Attorney, Agent, or Firm* — West & Associates APC

(57) ABSTRACT

A compact, flexible device capable of receiving a human finger which allows a person to easily and efficiently smooth filler material into a desired space, while also allowing the user to handle other objects and/or complete other tasks without removing the device from his or her person.

14 Claims, 8 Drawing Sheets

DEVICE FOR APPLYING FILLER MATERIAL

CLAIM OF PRIORITY

The present application claims the benefit of priority to prior-filed provisional patent application Ser. No. 60/894,811, filed Mar. 14, 2007, the complete contents of which is hereby incorporated herein by reference.

BACKGROUND

1. Field of the Invention

The present disclosure relates to the field of construction equipment, particularly a device for easily applying filler material into hard-to-reach places such as, but not limited to, corners, joints, seams, or gaps.

2. Background

People engaged in construction work or house painting often rely heavily on filler materials, such as caulk, to seal corners, joints, seams, gaps, or the like. It is critical that these filler materials be properly applied so as to form a watertight and/or airtight seal and/or for aesthetic purposes. To achieve this purpose, a person must first apply filler material from a container and/or caulking gun to accomplish a desired result, be it aesthetic or otherwise, to the area to be sealed. The filler material then needs to be spread out and/or smoothed such that the area is completely covered with filler material and excess is removed, thus creating a proper seal and pleasing aesthetic. This second step can prove especially daunting when filler material must be applied to hard-to-reach places, such as corners, joints, seams, gaps, or the like. In addition, a person engaged in applying filler material to such spaces is also usually involved in other building activities and carries around and uses several tools or other objects. It is therefore advantageous for a worker to minimize the number of tools or objects needed for a particular job while also working in a timely and efficient manner. What is needed is a compact, lightweight device which allows a person to easily and properly smooth filler material into a desired space, while also allowing the user to handle other objects and/or complete other tasks without removing the device from his or her person.

Several hand-held products exist which are intended to aid in the application and/or smoothing of filler material. For example, U.S. Pat. No. 5,675,860 issued to Campbell teaches a hand-held applicator with a tapered head and traditional tool handle. Similarly, U.S. Pat. No. 3,964,854 issued to Groeneveld teaches a hand-held implement with a handle and a head for finishing tile joints. U.S. Pat. No. 5,018,956 issued to Lemaster teaches a hand-held glazing tool with trimming blades and a handle plate intended to be gripped with the thumb and forefinger of a user. While the aforementioned tools may assist in the application and/or smoothing of filler material, they lack much needed properties. First, these types of products must be held in and guided by a user's hand, leaving only one hand free to perform other tasks. Second, filler material is usually applied to only small areas at a time and then smoothed before drying in order to ensure proper sealing and aesthetic. With the above-mentioned implements, a user must apply filler material from a container, put the container down, pick up and use the smoothing tool, and then place the smoothing tool back down on a surface to start the process again on another area of a corner, joint, seam, gap, or the like. This process is not only tedious but inefficient, especially for workers cramped in small spaces or faced with large projects. Finally, and perhaps most importantly, using a hand-held tool is not nearly as effective as using one's finger to manipulate and smooth filler material. A user has the greatest control over the quality of filler material application as well as aesthetic appeal when using a finger to smooth and wipe away excess material. Hand-held implements simply do not provide this type of control and effectiveness.

While using one's finger to manipulate filler material is preferable, a user should still have as little contact as possible with the filler material, which may or may not be hazardous, to avoid potential damage or injury to the user's skin from abrasion or contact with the material—that is, use over an extended period of time whether the material is hazardous or not, may cause irritation or abrasion of the finger. Some existing products attempt to combine the effectiveness of finger use with protective covering to prevent contact with filler material. For example, U.S. Pat. No. 6,305,926 issued to Ray teaches an elongated hollow body with a closed end and an open end for receiving a finger. The closed end of the device can be used to apply and/or smooth filler material. However, the Ray device provides the user with access to only a single radius of curvature and does not allow a user to reach into converging gaps or corners. It can also be difficult to grip other objects or perform other tasks while wearing the Ray device. Another product, U.S. Pat. No. 4,177,698 issued to Greneker, teaches a finger implement which slips over one finger and has wing extensions, but also requires a person to use their thumb for precision control. The Greneker device is not only bulky but also limits a user's ability to grip other objects while wearing the device. Additionally, the Greneker device is not specifically meant for smoothing filler material and thus would require an additional attachment to properly accommodate the task.

What is needed is a compact, flexible finger device which allows a person to easily and efficiently smooth filler material at a desired radius of curvature into a desired space, while also allowing the user to handle other objects and/or complete other tasks without removing the device from his or her person.

DETAILED DESCRIPTION

Figure 1:
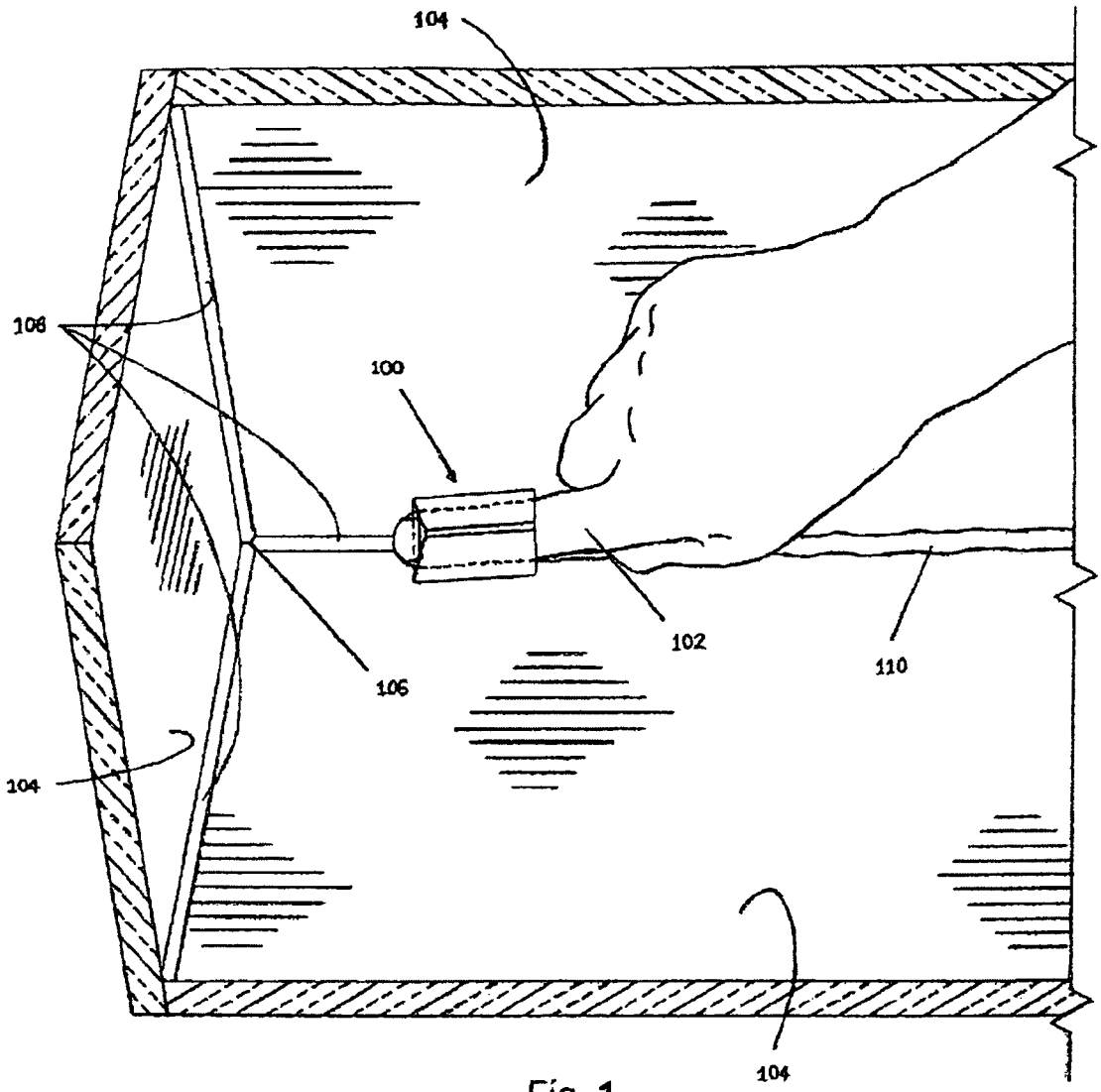
FIG. 1 depicts a view of one embodiment of the present device being used to manipulate filler material into a space between pieces of building material to form a seal.

As shown in FIG. 1, the present device can be an elongated hollow member 100. An elongated hollow member 100 can be placed over a finger 102 and used to apply and/or smooth filler material 110 into spaces 108 and/or a corner 106 between pieces of building material 104. An elongated hollow member 100 can be made of elastomer, rubber, silicone, or any other known and/or convenient flexible material having any desired elastomeric properties, and can be made in various sizes to accommodate different sizes of a finger 102. An elongated hollow member 100 can also be made in a variety of colors and the interior or exterior surface can be smooth, ribbed, or have any other known and/or convenient surface texture. Filler material 110 can be caulk, tile grout, silicone sealant, or any other known and/or convenient material.

Figure 2:
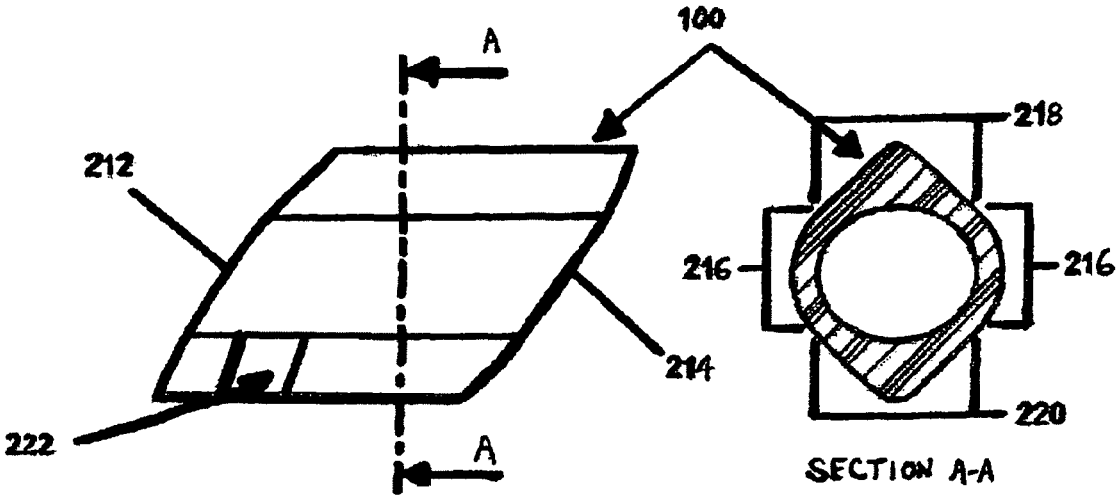
FIG. 2 depicts a side view of one embodiment of the present device and corresponding cross-sectional view through segment A-A.

FIG. 2 depicts a side view of the present device. An elongated hollow member 100 can have two open ends 212 and 214. In some embodiments, ends 212 and 214 can be substantially parallel to each other and angled with respect to a vertical midline A-A. In other embodiments, ends 212 and 214 can also be curved toward or away from a vertical midline A-A. FIG. 2 also shows a cross-sectional view of an elongated hollow member 100 through vertical midline A-A. An elongated hollow member 100 can have exterior side walls 216 that can converge to form substantially pointed edges 218, 220. In some embodiments, substantially pointed edges 218 can be uniform and the edge can have a predetermined radius, but in other embodiments can have a sharp edge. In some embodiments the opposing edges 218, 220 can have the same radius and/or the radii can be different, thus allowing a user to select a desired radius. In still further alternate embodiments the radius along a single edge 218, 220 can be non-uniform and/or can be graduated either uniformly, non-uniformly and/or in a step-wise manner 222, such that various radii are available to a user along a single edge 218, 220. Thus, a user can selectively control the radius of the interface of the exterior side walls 216 either by pressure and/or angle of the elongated hollow member 100 relative to the surfaces and/or by trimming the elongated hollow member 100 at a point where the elongated hollow member 100 has a desired radius. In some embodiments, as shown in FIG. 2, at least one of ends 212 and 214 can be shaped in an elliptical arc, a chord of which can extend between opposite substantially pointed edges 218 being angled with respect to a vertical midline A-A. In embodiments having only one of ends 212 and 214 shaped in an elliptical arc, an opposite end can be shaped in any known and/or convenient geometry. In embodiments in which both ends 212 and 214 are shaped in corresponding elliptical arcs, the chords of which extending between opposite substantially pointed edges 218 and being angled with respect to a vertical midline A-A can be substantially parallel to each other. In some embodiments, the interior cross-sectional geometry of an elongated hollow member 100 can be substantially round, but in other embodiments can be elliptical and/or have any known and/or convenient geometry.

Figure 2A:
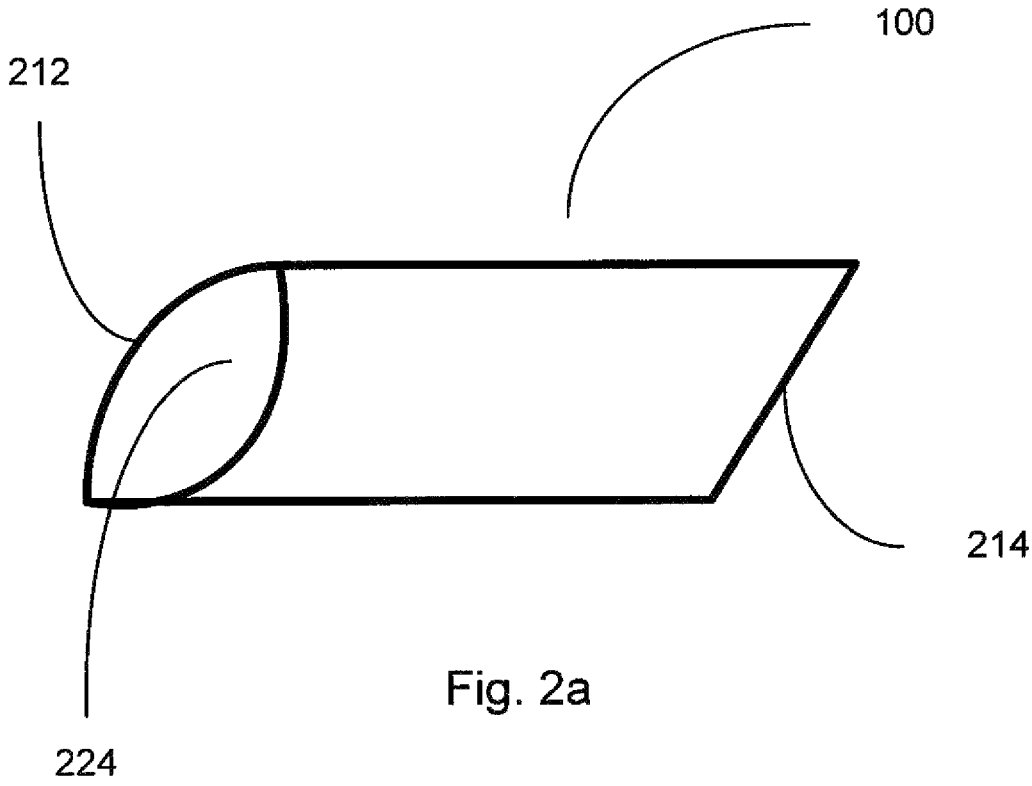
FIG. 2*a* depicts a side view of another embodiment of the present device.

FIG. 2*a* shows a side view of another embodiment of the present device. In some embodiments, as shown in FIG. 2*a*, a portion of the wall of an elongated hollow member 100 can be removed at one or both ends 212 and 214 to form a cutout region 224 Although shown in FIG. 2*a* as being elliptoid and symmetric about the longitudinal axis of an elongated hollow member 100, a cutout region 216 can be oriented at any known and/or convenient position on the wall of an elongated hollow member 100 and have any known and/or convenient geometry. In some embodiments, the elongated hollow member 100 can more than one cut out region 216 and the cut out regions 216 can be symmetric, substantially symmetric and/or asymmetric. In still further alternate embodiments, the cut out regions 216 can be located in any convenient location along the elongated hollow member 100 and/or can have any convenient geometry.

Figure 3:
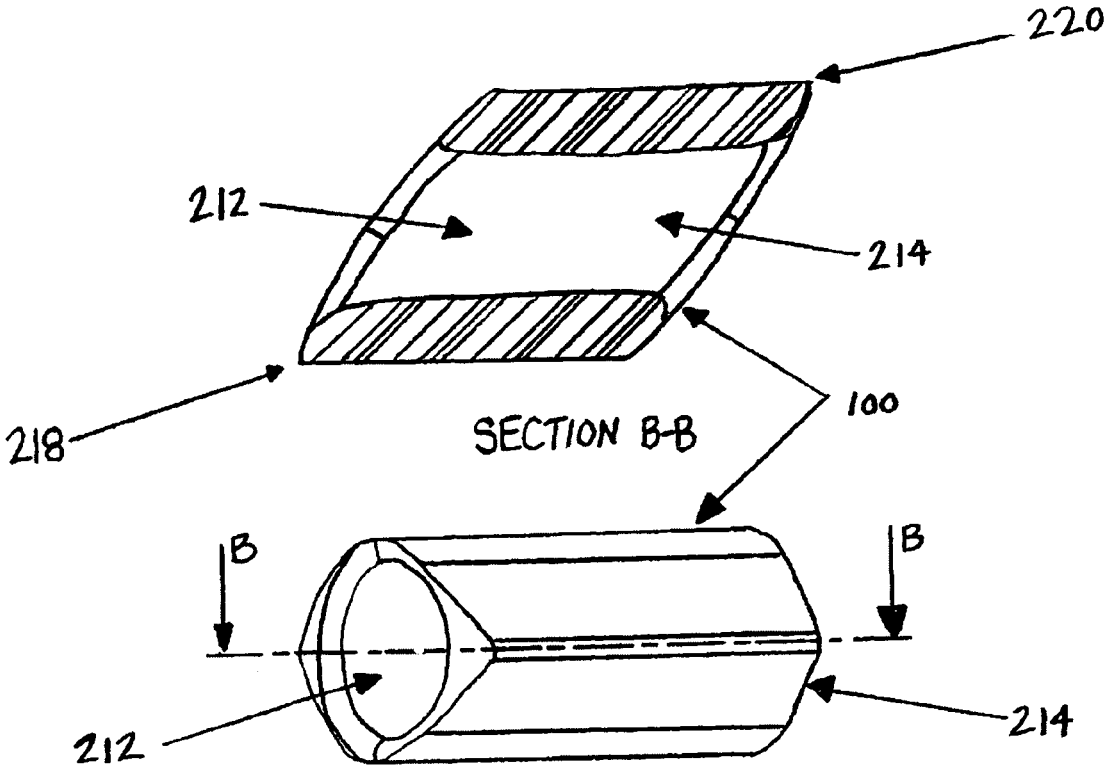
FIG. 3 depicts a top view of one embodiment of the present device and corresponding cross-sectional view through segment B-B.

FIG. 3 depicts a top view of the present device. An elongated hollow member 100 can have opposite open ends 312 and 314. Also shown in FIG. 3 is a cross-section of an elongated hollow member 100 through horizontal midline B-B, which slices longitudinally through pointed edges 218. Interior walls of an elongated hollow member 100 can be substantially parallel or any known and/or convenient geometry.

Figure 3A:
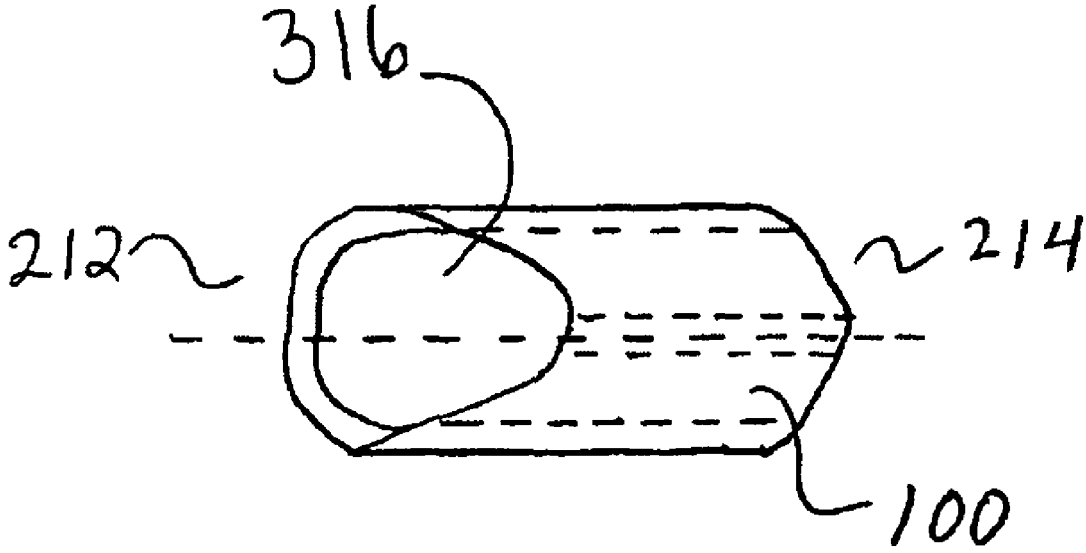
FIG. 3*a* depicts a top view of another embodiment of the present device.

FIG. 3*a* depicts a top view of another embodiment of the present device. In some embodiments, as shown in FIG. 3*a*, a portion of the wall of an elongated hollow member 100 can be removed at one or both ends 212 and 214 to form a cutout region 224. Although shown in FIG. 3*a* as being elliptoid and symmetric about horizontal midline B-B, a cutout region 224 can be oriented at any known and/or convenient position on the wall of an elongated hollow member 100 and have any known and/or convenient geometry. In some embodiments, the elongated hollow member 100 can include more than one cut out region 224 and the cut out regions 224 can be symmetric, substantially symmetric and/or asymmetric. In still further alternate embodiments, the cut out regions 224 can be located in any convenient location along the elongated hollow member 100 and/or can have any convenient geometry.

Figure 4:
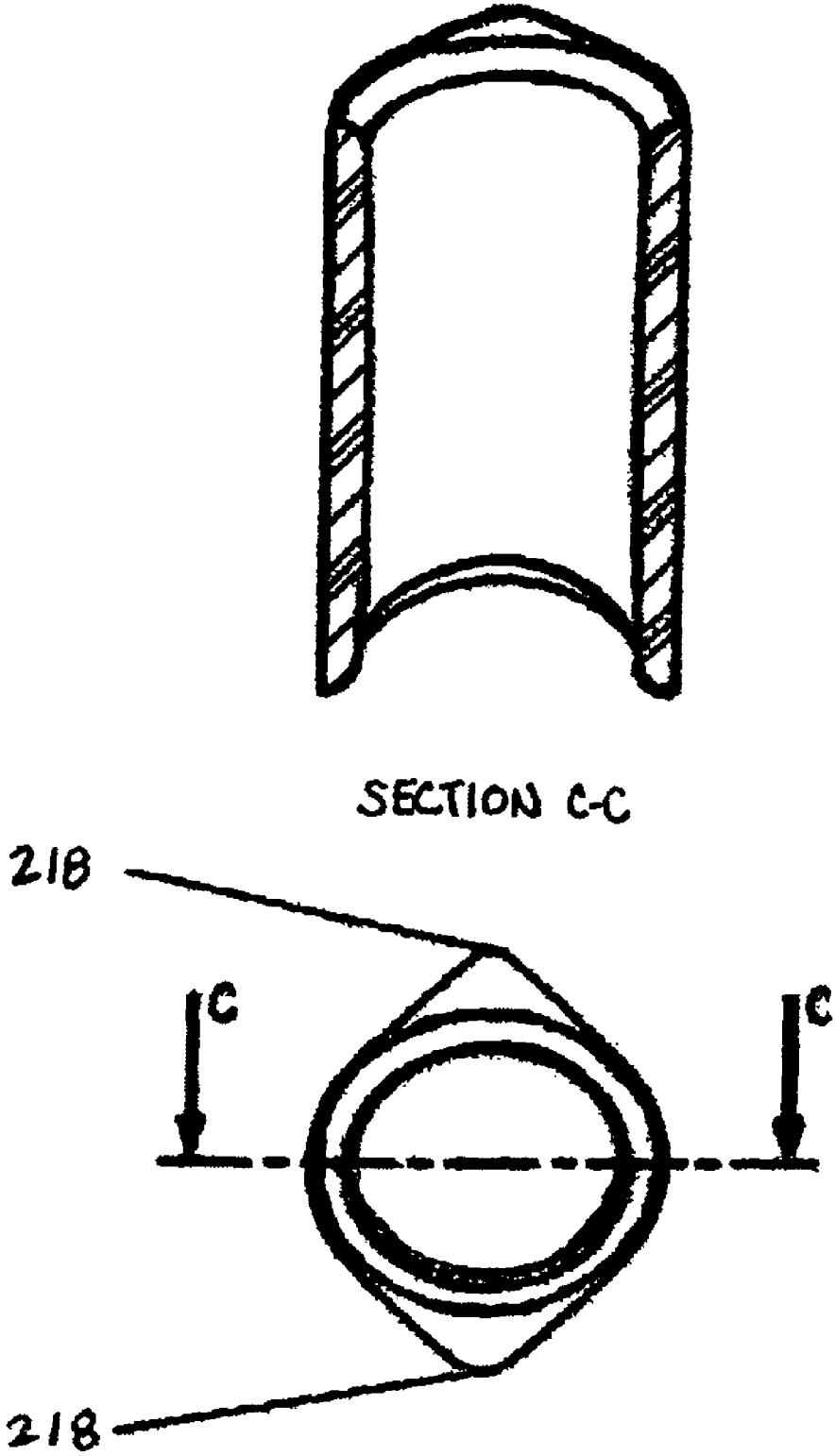
FIG. 4 depicts an end view of one embodiment of the present device and corresponding cross-sectional view through segment C-C.

FIG. 4 depicts an end view of the present device and corresponding cross-sectional view through segment C-C. Exterior side walls 216 can have a substantially uniform thickness through segment C-C before thickening and converging to form substantially pointed edges 218, which can be of various radii.

Figure 5:
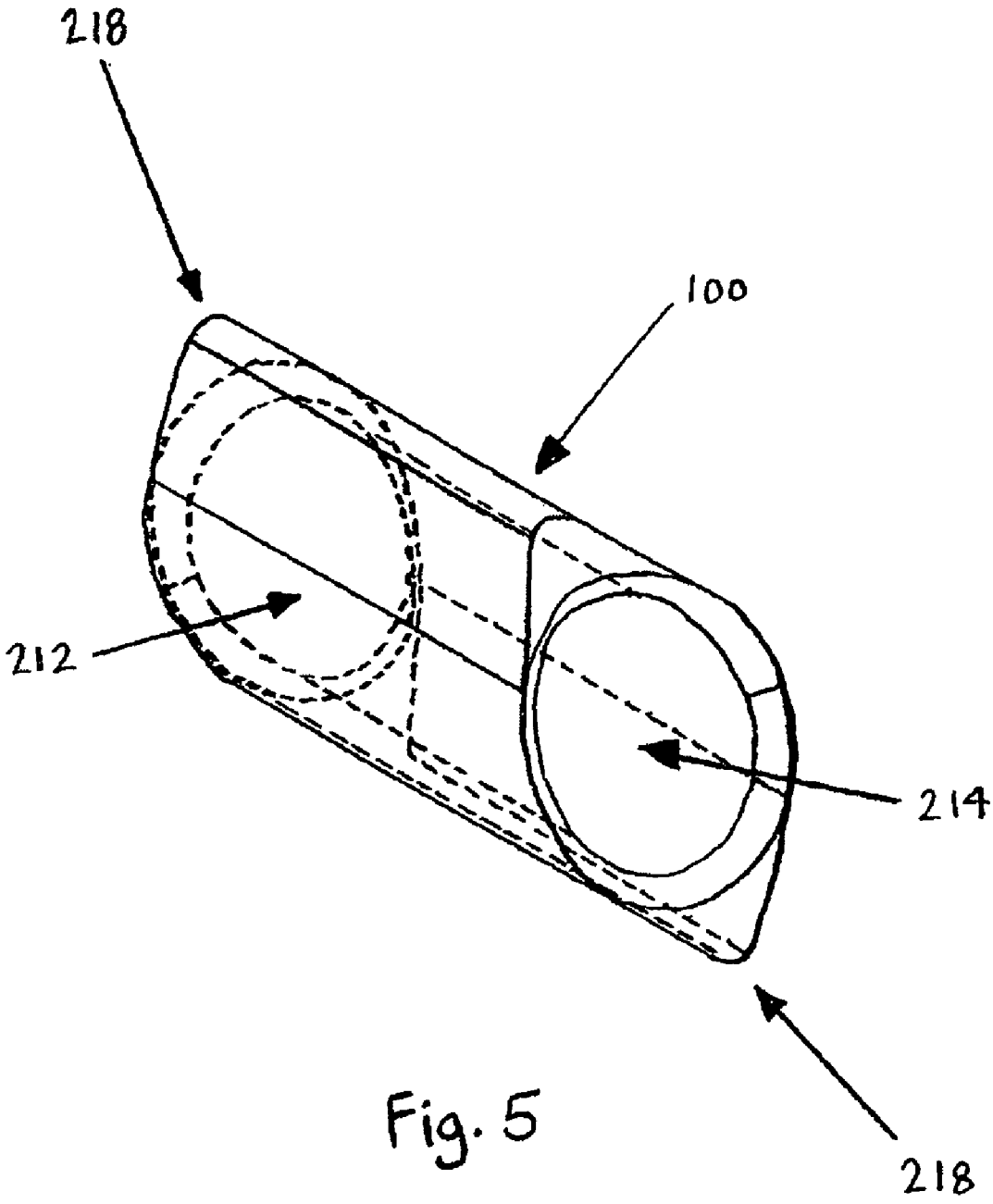
FIG. 5 depicts a perspective view of one embodiment of the present device.

FIG. 5 shows a perspective view of an elongated hollow member 100 with pointed edges 218 and opposite open ends 212 and 214.

Figure 6:
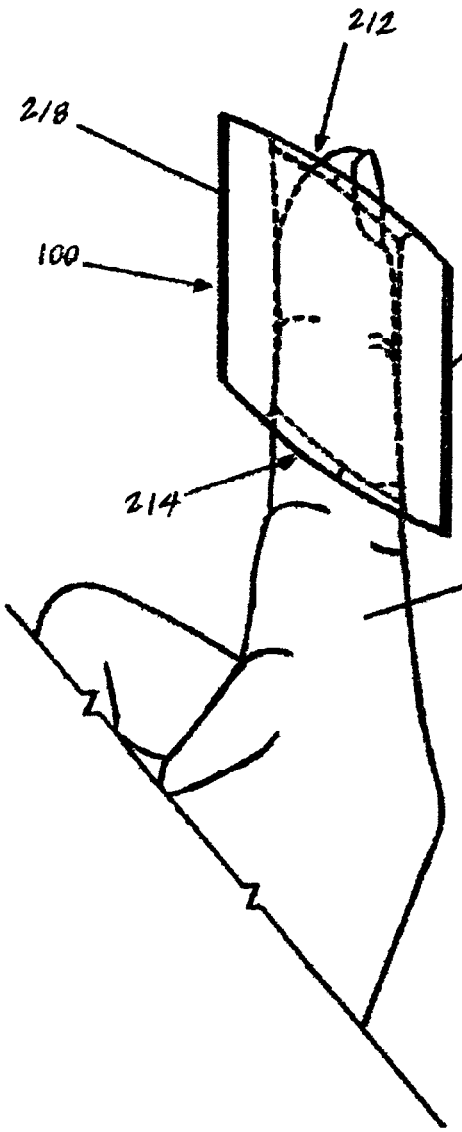
FIGS. 6 and 7 depict side views of one embodiment of the present device as worn on a human finger.
Figure 7:
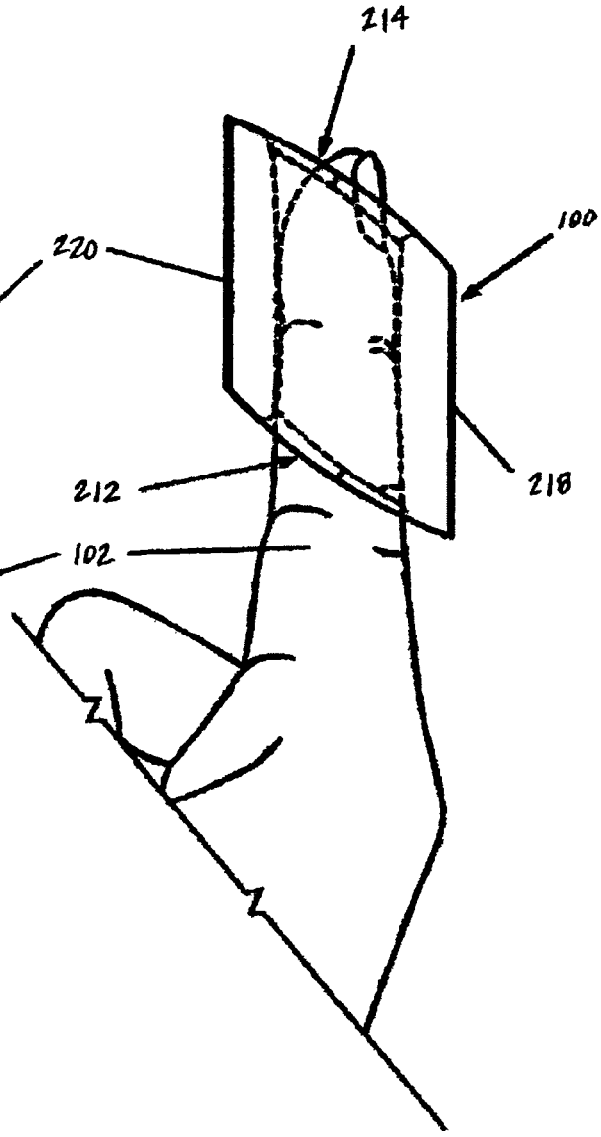

In use, a user can apply a filler material 110 to a space 108 between at least two pieces of building material 104, as shown in FIG. 1. A use can then insert a finger 102 into either open end 212 or open end 214 of an elongated hollow member 100 such that pointed walls 218 are substantially aligned with the finger pad and fingernail of a finger 102, as shown in FIGS. 6 and 7. Once an elongated hollow member 100 is securely over a finger 102, a user can drag the tip of a pointed wall 218 along filler material 110 to smooth the filler material 110 and create a proper seal in the space 108 between building materials 104. The present device can also be used to wipe away excess filler material 110 and/or manipulate filler material 110 in a corner 106, or can be used in any other known and/or convenient manner. The present device can also be worn on a finger 102 while a user is tending to other tasks or holding other objects. In the embodiment in which the radii of the edges 218 220 are different, a user can access and use a desired edge with a desired radius by inserting a finger through the appropriate end the elongated hollow member 100.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. An implement for manipulating filler material, comprising:

an elongated hollow member comprised of substantially flexible material;

said elongated hollow member having a horizontal axis and a vertical axis;

the interior of said elongated hollow member having opposite side walls along said horizontal axis;

said side walls converging to form opposite substantially pointed edges each having an apex along said horizontal axis;

wherein the perpendicular distance from said apexes to the interior surface of said elongated member is greater than the perpendicular distance from the exterior surface of said side walls to the interior surface of said elongated member;

said elongated hollow member having opposite open ends along said horizontal axis;

wherein at least one of said open ends having a longitudinal cross-section shaped in an elliptical arc, the chord of said arc extending between said opposite substantially pointed edges and being angled with respect to the vertical axis.

2. The implement of claim 1, wherein said elongated hollow member is made of an elastomer.

3. The implement of claim 1, wherein said elongated hollow member is made of silicone.

4. The implement of claim 1, wherein the exterior surface of said elongated hollow member is smooth.

5. The implement of claim 1, wherein the exterior surface of said elongated hollow member is ribbed.

6. The implement of claim 1, wherein said elongated hollow member is capable of fitting securely to a human finger.

7. The implement of claim 1, wherein both open ends are shaped in elliptical arcs, the chords of said arcs extending between said opposite substantially pointed edges and being angled with respect to the vertical axis and substantially parallel to each other.

8. The implement of claim 7, wherein said elongated hollow member is made of rubber.

9. The implement of claim 7, wherein said elongated hollow member is made of silicone.

10. The implement of claim 7, wherein the exterior surface of said elongated hollow member is smooth.

11. The implement of claim 7, wherein the exterior surface of said elongated hollow member is ribbed.

12. The implement of claim 7, wherein said elongated hollow member is capable of fitting securely to a human finger.

13. The implement of claim 1, further comprising a cutout region in the wall of said elongated hollow member at least one of said opposite ends.

14. The implement of claim 7, wherein said elongated hollow member is made of an elastomer.

* * * * *